United States Patent [19]

Teranishi

[11] Patent Number: 4,846,158

[45] Date of Patent: Jul. 11, 1989

[54] HAND TYPE ELECTRIC MASSAGE MACHINE

[76] Inventor: Akihiko Teranishi, 110, 3-chomea, Hisakata, Tenpaku-ku, Nagoya City, Aichi Prefecture, Japan

[21] Appl. No.: 233,937

[22] Filed: Aug. 15, 1988

Related U.S. Application Data

[63] Continuation of Ser. No. 59,121, Jun. 3, 1987, abandoned.

[30] Foreign Application Priority Data

Jun. 6, 1986 [JP] Japan ..... 61-86787
Dec. 2, 1986 [JP] Japan ..... 61-185892

[51] Int. Cl.[4] ..... A61H 1/00
[52] U.S. Cl. ..... 128/36; 128/67
[58] Field of Search ..... 128/34–36, 128/51–55, 44–46, 60, 59, 62 R, 67

[56] References Cited

U.S. PATENT DOCUMENTS

| | | | |
|---|---|---|---|
| 455,567 | 7/1891 | Kraft | 128/62 R |
| 3,468,304 | 9/1969 | Teranishi | 128/36 |
| 3,585,990 | 6/1971 | Blachly | 128/36 |
| 3,672,355 | 6/1972 | Ogawa et al. | 128/36 |
| 3,710,785 | 1/1973 | Hilger | 128/36 |
| 3,735,757 | 5/1973 | MacFarland | 128/36 |
| 4,102,334 | 7/1978 | Muchisky | 128/55 |
| 4,409,967 | 10/1983 | Gueret | 128/62 R |
| 4,604,993 | 8/1986 | Moriwaki et al. | 128/54 |

FOREIGN PATENT DOCUMENTS

| | | |
|---|---|---|
| 52-53199 | 12/1977 | Japan . |
| 53-93991 | 7/1978 | Japan . |
| 56-4011 | 1/1981 | Japan . |
| 56-4012 | 1/1981 | Japan . |
| 57-42428 | 9/1982 | Japan . |
| 60-184534 | 12/1985 | Japan . |

*Primary Examiner*—Edgar S. Burr
*Assistant Examiner*—Huong Q. Pham
*Attorney, Agent, or Firm*—Wenderoth, Lind & Ponack

[57] ABSTRACT

In a hand type electric massage machine, a vibration head is connected through a coupling spring to a top end portion of a hand case, and an unbalance weight is rotatably mounted to a top end portion of a rotary shaft so that the center of gravity of a weight element is positioned on a line extending radially from a bearing of the rotary shaft. The weight element is fixed to a part of the periphery of a lower end portion of a cylinder base having nearly covered cylindrical form including a disc portion and a skirt portion extending downward from the periphery of the disc portion. According to another feature of the present invention, the longitudinal ends of the vibration head are respectively provided with a curved surface extending in a vertical direction and with a curved profection surface having a smaller radius of curvature than that of the above-mentioned curved surface and lateral sides thereof include a spherical surface member having an elastic body and with a spherical surface member having a number of small projections, respectively. The size of the bearing can be varied and lubricating oil is not scattered, and the massage machine is suitable for massage in various modes.

5 Claims, 5 Drawing Sheets

FIG. 9 - PRIOR ART
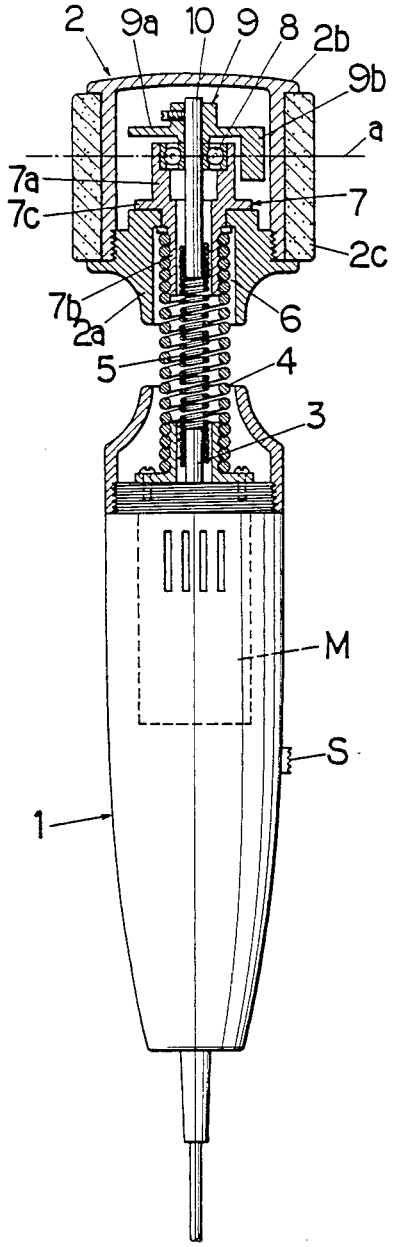
FIG. 10 - PRIOR ART
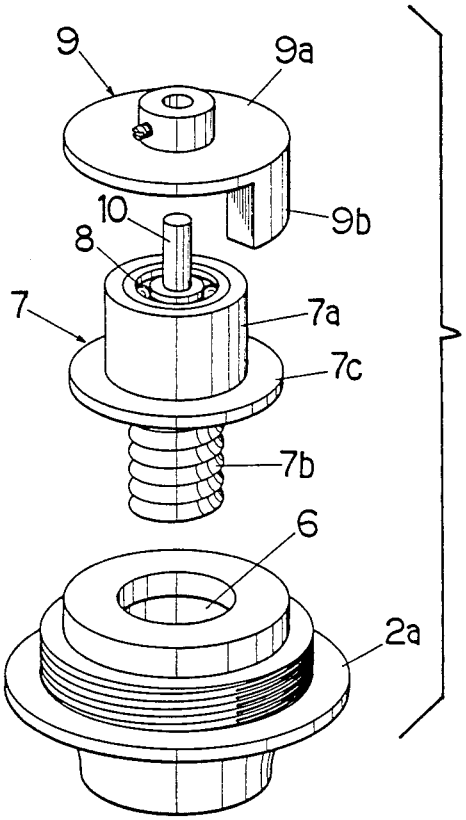

HAND TYPE ELECTRIC MASSAGE MACHINE

This application is a continuation of application Ser. No. 059,121 filed June 3, 1987.

BACKGROUND OF THE INVENTION

The present invention relates to a hand type electric message machine, and more specifically to a massage machine in which a head is flexibly coupled to a hand case and is vibrated so as to provide massage effect, and an improvement made in the mounting structure of an unbalance weight installed to vibrate the head. More specifically, the the unbalance weight is installed so that the center of gravity of a weight element is positioned on a line extending radially from a bearing in a vibration head member.

In a conventional head type massage machine, a head is flexibly coupled to a hand case and an unbalance weight contained in the head is rotated and thus, the head is vibrated, and a massage effect is obtained through the vibration of the head. A conventional method for mounting an unbalance weight on a head is that a longitudinal pair of bearings are installed within the head, a motor is contained in a hand case and a top end portion of a rotary shaft coupled through a transmission spring with an output shaft of the motor is supported by both bearings, and the unbalance weight is mounted on the top end portion of the rotary shaft at position between both bearings. In this method, however, work to make the center of both bearings coincident during the assembling is quite troublesome, and if the center is not coincident the bearing portion will be subjected to heat, seizure, partial abrasion, noise or the like. In order to improve the above-mentioned situation, a mounting structure of an unbalance weight has been proposed by the present applicant (Japanese utility model application laid-open No. 18453/1985). That is, as shown in FIGS. 9 and 10, a motor M is contained in a hand case 1 and a top end portion of a rotary shaft 10 extending from the motor M through a transmission spring 5 is supported by a single bearing 8 in a head 2, and an unbalance weight 9 comprising a base portion 9*a* and a weight element 9*b* formed on a part of a periphery of the base portion 9*a* is mounted on the top end portion of the rotary shaft 10 so that the center of gravity of the weight element 9*b* is positioned on a line extending radially of the bearing 8, and the unbalance weight 9 is rotated. In this mounting structure of the unbalance weight, a problem resulting from heat is not produced and the assembling work is simple.

In the above-mentioned mounting structure of the unbalance weight in the prior art, since the unbalance weight comprising the base portion (disc portion) and the weight element formed on a part of the periphery of the base portion is mounted on the top end portion of the rotary shaft supported by the bearing, for example, when the set weight of the weight element is changed and the size of the bearing is varied corresponding to the set weight or when a space for interposing an elastic washer is provided between the unbalance weight and the bearing, the center of gravity of the weight element is not positioned on the line extending in a radial direction of the bearing and twisting will be produced in the rotary shaft. In other words, a first problem of this mounting structure is in that a space for an elastic washer cannot be provided or size (length) of the bearing cannot be freely set.

Since the unbalance weight is formed by fixing the weight element directly to the base portion (disc portion) as described above, during the rotational motion of the rotary shaft, lubricating oil of the bearing is scattered from a gap between the unbalance weight and the bearing towards a head cover and adheres to the head cover so as to damage it, and the lubricating oil leaks out of the head cover and the commercial value of the massage machine is deteriorated. This unfavorable state results in a second problem. In order to eliminate such an unfavorable state, oil-resistant material must be used as a raw material for the head cover and therefore the cost of the product is increased resulting in another disadvantage.

Additionally, the form of the vibration head is also an important factor to give variation to the massage action. Various massage machines of the vibration type have been proposed as hereinafter described where a plurality of kinds of massage action can be obtained by improving the shape of the vibration head:

(1) a massage machine where a convex curved surface and a concave curved surface are formed on outer circumferential portion of a vibration head corresponding to unevenness of a diseased part (Japanese utility model publication No. 53199/1977)

(2) a massage machine where the outer circumferential portion of a vibration head is formed as an ellipse having plural curved surfaces with different radii of curvature and thus, the degree of contact with a diseased part can be varied (Japanese utility model publication No. 4011/1981)

(3) a massage machine where three massage positions, i.e., circular arc surface, flat surface, square surface, are formed on an outer circumferential portion of a vibration head (Japanese utility model publication No. 4012/1981)

(4) a massage machine where a buffer cover for enclosing a buffer and a cover having hard projections are fixed on the outer circumferential portion of a vibration head and thus, soft massage and point massage can be obtained (Japanese utility model publication No. 42428/1982).

In addition to the above description, a massage machine where a vibrator attachment is detachably exchangeably installed to a vibration head (Japanese utility model application laid-open No. 93991/1978) has been proposed.

In each of the above-mentioned proposed items (1) through (4), a problem to be improved is in that only two or three massage positions can be obtained, in other words, various parts of the vibration head are not utilized as massage positions effectively to the maximum. Also in the proposal of installing the vibrator as attachment, a problem is in that the exchangeable and detachable installation is troublesome and the cost of the device becomes high.

SUMMARY OF THE INVENTION

An object of the invention is to provide a hand type electric massage machine wherein the size of a bearing can be freely selected.

Another object of the invention is to provide a hand type electric massage machine wherein lubricating oil is not scattered and does not contaminate a head case.

Still another object of the invention is to provide a hand type electric massage machine wherein one vibration head can perform massage in various modes to deep, intermediate or skin portions of a diseased part.

In order to attain the above objects, the invention provides a hand type electric massage machine in which an unbalance weight is comprised of a cylinder base having a nearly covered cylindrical form including a disc portion and a skirt portion extending downward from the periphery of the disc portion and of a weight element fixed to a part of the periphery of a lower end portion of the cylinder base mounted, and is on the top end portion of a rotary shaft.

In order to further attain the above-described objects, the invention provides a hand type electric massage machine in which the longitudinal ends of a vibration head respectively have a curved surface extending vertically and having a suitable radius of curvature and with another curved surface formed at smaller radius of curvature than that of the above-mentioned curved surface by projecting, and the lateral surfaces are provided, respective, with a spherical surface member formed by an elastic body and a spherical surface member formed by group of small projections.

BRIEF DESCRIPTION OF THE DRAWINGS

FIG. 9 is a partial sectional view of a hand type electric massage machine in the prior art; and FIG. 10 is an exploded perspective view of the mounting portion of an unbalance weight of the prior art massage machine.

DESCRIPTION OF THE PREFERRED EMBODIMENTS

Preferred embodiments of the invention will now be described referring to the accompanying drawings.

Figure 1:
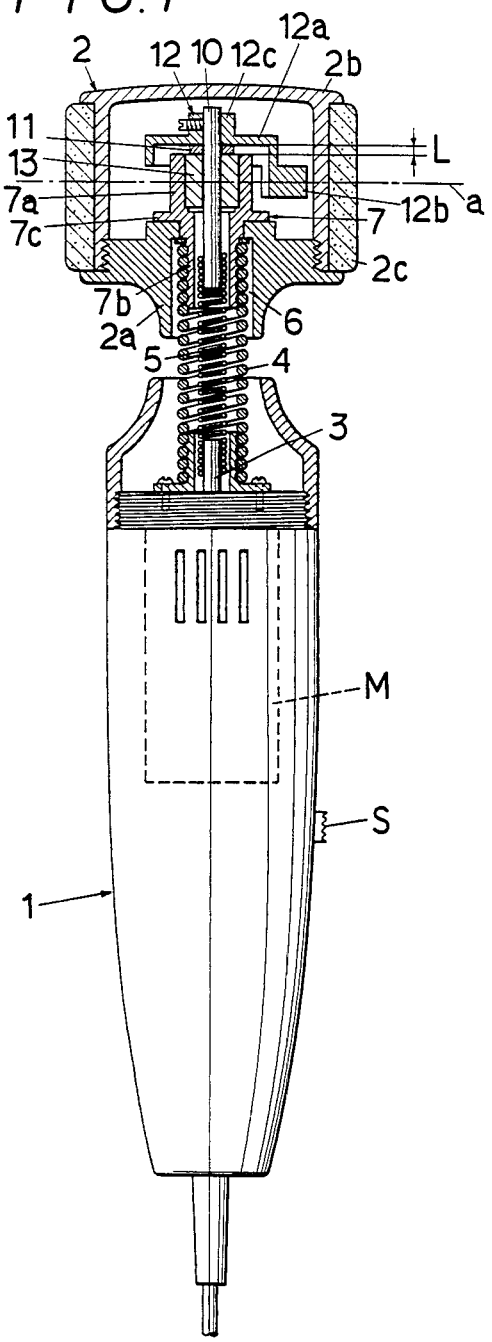
FIG. 1 is a partial sectional view of a hand type electric massage machine having an unbalance weight according to the invention.
Figure 2:
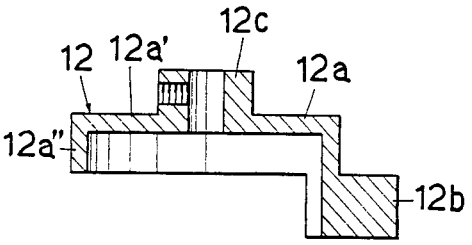
FIG. 2 is an enlarged sectional view of the balance weight.
Figure 3:
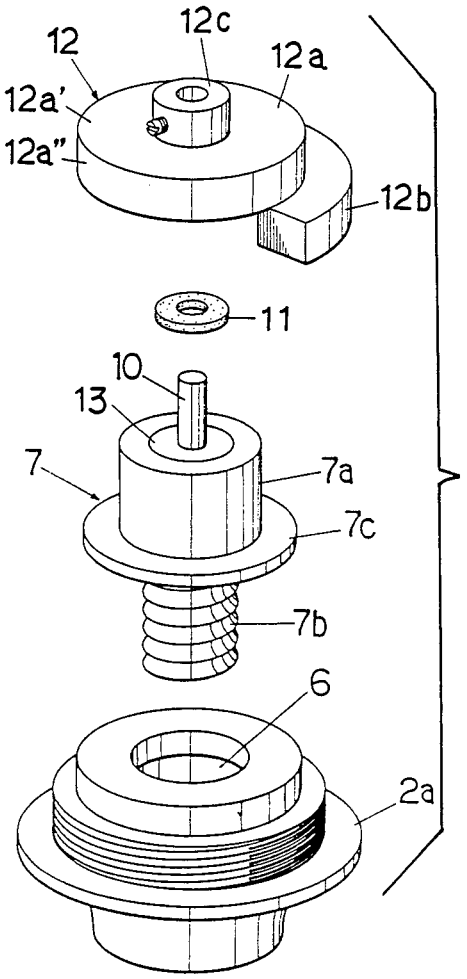
FIG. 3 is an exploded perspective view of a mounting portion of the unbalance weight.
Figure 4:
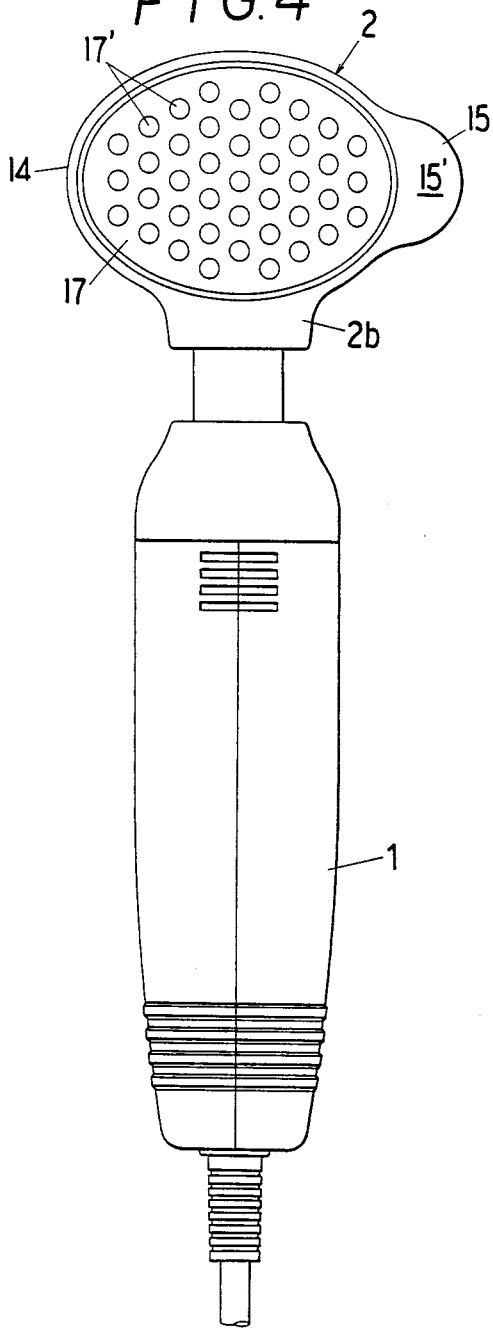
FIG. 4 is a front view of a hand type electric massage machine with an improved vibration head according to the invention.
Figure 5:
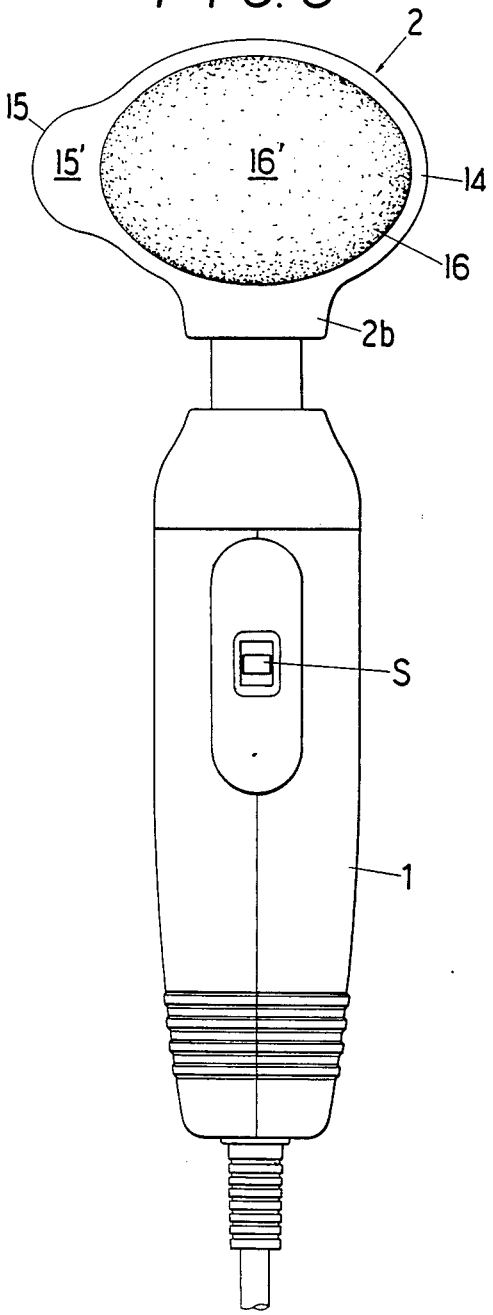
FIG. 5 is a rear view of the massage machine.
Figure 6:
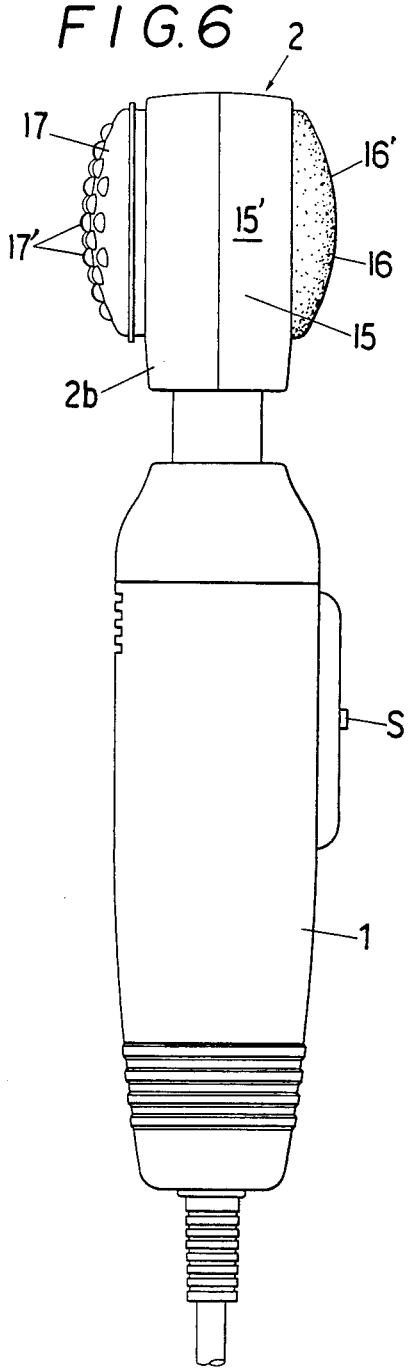
FIG. 6 is a right side view of the massage machine.
Figure 8:
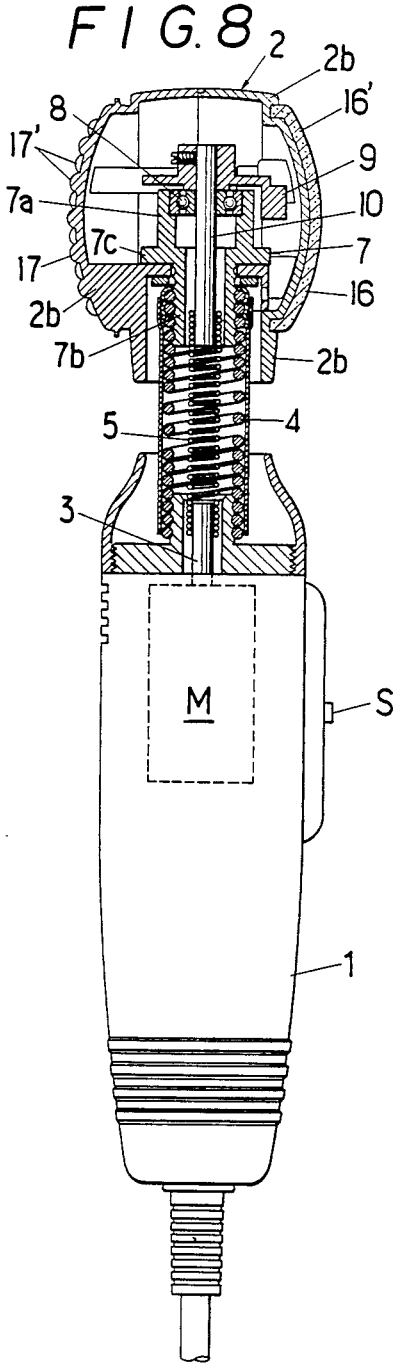
FIG. 8 is a partial sectional view of the massage machine.
Figure 7:
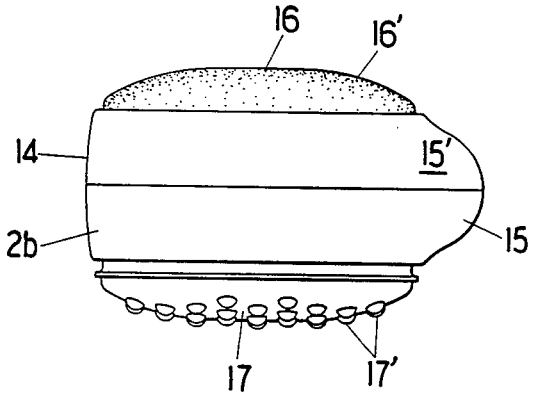
FIG. 7 is a plan view of the massage machine.

FIGS. 1–3 show an embodiment of the invention where mounting structure of an unbalance weight is improved. Numeral 1 designates a hand case, and numeral 2 designates a head connected to the top end of the hand case 1. The hand case 1 is formed as a long cylinder. A motor M is incorporated in the hand case 1 and an output shaft 3 thereof projects from the motor to the top end of the case 1, and a switch S for ON/OFF operation of the motor M is provided on the periphery of the case 1. A coupling spring 4 extends from the top end of the case 1 and surrounds the output shaft 3, and the head 2 is coupled to a top end portion of the spring 4 in a flexible rockable state.

The head 2 comprises a disc-like head base **2*a* provided on the center with a through hole 6 to enable the coupling spring 4 and a transmission spring 5 as hereinafter described to pass therewith, a head cover 2*b* having a covered cylindrical form comprising a hollow portion for covering the head base 2*a*, and an annular elastic body 2*c* wound on a periphery wall of the cover 2*b*. A bearing housing 7 is installed in the hollow portion of the head 2. The bearing housing 7 is comprised of a bearing cylinder 7*a* and a coupling cylinder 7*b* projecting in opposite directions, and of a flange 7*c* extending therebetween. The coupling cylinder 7*b* is fitted in the through hole 6, and the top end portion of the coupling spring 4 is connected to the coupling cylinder 7*b*. A bearing 13 is installed on the bearing cylinder 7*a*, and a rotary shaft 10 is journaled to the bearing 13. The rotary shaft 10 and the output shaft 3 are coupled by the transmission spring 5. A suitable space L is provided between a ceiling surface of an imbalance weight 12 and the bearing 13, and the unbalance weight 12 mounted above the space L occupied by an elastic washer 11**.

The balance weight 12 comprises a cylinder base **12*a* having a nearly covered cylindrical shape including a disc portion 12*a*' and a skirt portion 12*a*'' extending downward from a peripheral portion of the disc portion 12*a*' over a predetermined length, and a weight element 12*b* fixed to the bottom end of the cylinder base 12*a* at a part of the periphery thereof. A mounting boss 12*c* for mounting the unbalance weight 12 to the rotary shaft 10 projects upward from the disc portion 12*a*' of the cylinder base 12*a*. In the cyinder base 12*a*, the disc portion 12*a*' has a diameter larger than that of the coupling cylinder 7*b*, and a length of the skirt portion 12*a*'' is larger than distance of the space L. The weight 12*b* is installed so that the center of gravity thereof is positioned on a extending through radial line the bearing 13 at an intermediate portion in the longitudinal direction thereof (the radial line being designated by symbol "a" in FIG. 1**).

The operation of the embodiment will be described.

The switch S is turned on, the motor M is started, and the drive force of the motor M is transmitted through the output shaft 3 and the transmission spring 5 to the rotary shaft 10 so as to rotate the rotary shaft 10. In this case, since the unbalance weight 12 is mounted on the rotary shaft 10, vibrations are generated by the head 2. When the vibration action is generated by the head 2, the head 2 is placed against on a diseased part and a stimulus is given to the diseased part and circulation of blood is urged, i.e., the massage action is obtained. In the invention, since the unbalance weight 12 is installed so that the center of gravity of the weight element **12*b* is positioned on a radial line extending in the radial direction of the bearing 13 from an intermediate portion in the longitudinal direction thereof during rotation the bearing 13 is not subjected to so-called twisting and the rotation is effected smoothly. That is, the rotation action is obtained without producing trouble such as heat, seizure, partial abrasion or noise in the bearing 13. Since the suitable space L is provided between the ceiling surface of the cylinder base 12*a* and the upper end of the bearing 13 and the elastic washer 11 corresponding to the weight element 12*b* is occupies the space L, thrust load acting in the direction of the rotary shaft 10 is received by the elastic washer 11 and the frictional noise generated between the unbalance weight 12 and the bearing 13 can be prevented. In the cylinder base 12*a*, since the skirt portion 12*a*'' has a length larger than the space L, the bearing 13 and the bearing cylinder 7*a* at the upper end and the periphery near the upper end can be covered by the cylinder base 12*a*, thereby preventing sputtering of the libricating oil produced from the bearing 13**.

Next, among the preferred embodiments of the invention, an example of improving the vibration head will be described referring to FIGS. 4–8.

A hand case 1 has a long cylindrical shape, a motor M is incorporated in the hand case 1 and an output shaft 3 of the motor M projects from the motor to top end portion of the case 1. A switch S for ON/OFF operation of the motor M is installed on the periphery of the case 1. A coupling spring 4 extends from the top end portion of the case 1 and surrounds the output shaft 3, and a vibration head 2 is flexibly coupled to the top end portion of the coupling spring 4 in a rockable state.

The vibration head 2 comprises a cap-like head cover 2*b* cap-like form. A bearing housing 7 is comprised of a bearing cylinder 7*a* and a coupling cylinder 7*b* projecting in opposite directions, and of a flange 7*c* extending therebetween. A top end portion of the coupling spring 4 is connected to the coupling cylinder 7*b*. A bearing 8 is installed on the bearing cylinder 7*a*, and a rotary shaft 10 is journaled to the bearing 8 and is disposed opposite to the output shaft 3. The rotary shaft 10 and the output shaft 3 are coupled by the transmission spring 5, and an unbalance weight 9 is mounted to a top end portion of the rotary shaft 10.

The head cover 2*b* extends in a longitudinal direction and has a nearly elliptical shape. An outer circumferential portion of the head cover 2*b* is gradually curved outward from the top end to project in a forward direction. That is, the front end has a curved surface 14 has a smaller radius of curvature than that of the top end. At the rear end of the head cover 2*b*, an integral projection 15' has a curved surface 15 formed with a smaller radius of curvature than that of the curved surface 14 formed at the front end. On the other hand, at both lateral sides of the head cover 2*b*, spherical surface members 16, 17 have smooth curved surfaces. One spherical surface member 16 is provided with an elastic body 16', and the other spherical surface member 17 is provided with a number of small projections 17'.

The operation of the embodiment shown in FIGS. 4~8 will be described.

The switch S is turned on, the motor M is started, and the drive force of the motor M is transmitted through the output shaft 3 and the transmission spring 5 to the rotary shaft 10 so as to rotate the rotary shaft 10. Since the unbalance weight 9 is mounted on the rotary shaft 10, vibrations are generated by the vibration head 2. When the vibration action is generated by the vibration head 2, the vibration head is placed against a diseased part and a stimulus is given to the diseased part and circulation of blood is urged, i.e., the massage action is obtained. More specifically, when the curved surface 15 with the projection 15' formed at the rear end of the head cover 2*b* is placed against a diseased part, in addition to the massage of deep portions, the massage of stimulating vertical aperture (so-called "affected part") can be obtained. When the curved surface 14 with gradually increasing curvature from the top end formed at the front end of the head cover 2*b* is placed against a diseased part, the massage of an intermediate portion can be obtained. That is, massage action suitable for the stimulation of muscles in the shoulder, waist, thigh or the like can be obtained. Among the spherical surface members 16, 17 formed on both lateral sides of the head cover 2*b*, when one spherical surface member 16 with the elastic body 16' is placed against a diseased part, soft massage can be provided throughout over a wide region. When other spherical member 17 with the small projections 17' is placed against a diseased part, action stimulating the skin portion can be provided over a wide region.

In the first embodiment (FIGS. 1–3), an unbalance weight is comprised of a cylinder base having a nearly covered cylindrical form including a disc portion and a skirt portion extending downward from the peripheral portion of the disc portion over a predetermined length, and of a weight element fixed to a part of the periphery of lower end portion of the cylinder base corresponding to a bearing. Thus, the center of gravity of the weight element can be easily positioned on a line extending radially from the center of the bearing by appropriate design of the length of the skirt portion. In with such a construction, the center of gravity of the weight element can be easily positioned on the line extending in the radial direction of the bearing, a space for interposing an elastic washer can be secured between the bearing and the unbalance weight, and length of the space and the size of the bearing can be set corresponding to weight of the weight element.

Also, since the unbalance weight is mounted on the rotary shaft so that the cylinder base covers the upper end of the bearing sputtering of lubricating oil out of the bearing to the head cover can be prevented by the inner circumferential surface of the skirt portion. Since sputtering of the lubricating oil can be prevented as described above, damage of the head cover can be prevented and the durability thereof can be improved, and furthermore leakage of the lubricating oil to outside of the head cover can be prevented so as to result in a massage machine that functions excellently.

On the other hand, in the second embodiment (FIGS. 4–8), each surface of the vibration head has an asymmetric form. That is, the vibration head is elongated in a longitudinal direction and has a nearly elliptical shape, and one end is provided with a curved surface having curvature increasing gradually from the top end so as to perform the massage of intermediate portion, and the other end is provided with a curved surface having a smaller radius of curvature than that of the above-mentioned curved surface because of the projection so as to perform the massage of a deep portion and vertical aperture. Spherical curved members with smooth curved surfaces are formed on both lateral sides of the vibration head, and one spherical surface member is provided with an elastic body so as to perform soft massage over a wide area, and the other spherical surface member is provided with a number of small projections so as to stimulate the skin portion. With this construction, single vibration head can perform massage in various modes.

What is claimed is:

1. A hand held type electric massage machine comprising:

a hand case;

a vibration head flexibly coupled to the hand case for establishing plural modes of vibration in the machine, said vibration head having a front end surface, a read end surface and respective lateral side surfaces each of which extends between said front end surface and said rear end surface, said lateral side surfaces each being curved and projecting laterally outward with respect to the vibration head in opposite directions from one another;

one of said side surfaces defined by an elastic body, and the other of said side surfaces having a plurality of projections extending therefrom, said front end surface being curved, projecting frontward with respect to the vibration head, and having a radius of curvature smaller than that of either of said curved lateral side surfaces, and said rear end surface including a projection projecting rearward with respect to the vibration head, said projection being defined by a curved surface having a radius of curvature smaller than that of any of said curved lateral side surfaces and said curved front end surface;

a bearing supporting within said vibration head;

a rotatable shaft extending in a longitudinal direction and rotatably supported in said bearing, the rotatable shaft having an end portion projecting from an end of said bearing, and drive means operatively connected to said rotatable shaft for rotating said shaft; and an imbalance weight mounted to the end portion of said shaft for rotating therewith, said imbalance weight including a disc portion through which the end portion of said shaft extends, a weight element having a center of gravity, and means for locating the center of gravity of said weight element at a position that is both offset from the central axis of said rotatable shaft and disposed along a line extending radially from said bearing and passing through an intermediate portion of said bearing with respect to said longitudinal direction, said means for locating comprising a skirt extending from the outer periphery of said disc portion to said weight element, and said skirt extending around said end portion of the bearing from which said end portion of the shaft projects.

2. A hand held type electric massage machine as claimed in claim 1, wherein said disc portion is spaced from said end of said bearing.

3. A hand held type electric massage machine as claimed in claim 2, and further comprising an elastic washer disposed between said disc portion and said end of said bearing for spacing said disc portion from said bearing.

4. A hand held type electric massage machine as claimed in claim 2, wherein said skirt portion is cylindrical and extends from said disc portion toward said end of said bearing and over a distance greater than the distance over which said disc portion is spaced from said end of said bearing so as to extend around said end of said bearing for preventing lubricating oil of said bearing from spattering on said vibration head.

5. A hand held type electric massage machine comprising:

a hand case;

a vibration head flexibly coupled to said hand case for establishing plural modes of vibration in the machine;

a bearing supported within said vibration head;

a rotatable shaft extending in a longitudinal direction and rotatably mounted in said bearing, the rotatable shaft having an end portion projecting from an end of said bearing, and drive means operatively connected to said rotatable shaft for rotating said shaft;

an unbalance weight mounted to the end portion of said shaft for rotating therewith, said unbalance weight including a weight element having a center of gravity offset from the central axis of said rotatable shaft for causing said vibration head to vibrate when said unbalance weight is rotated with said rotatable shaft by said drive means, and said center of gravity located along a line extending radially from said bearing and passing through an intermediate portion of said bearing with respect to said longitudinal direction; and said vibration head having a front end surface, a rear end surface and respective lateral side surfaces each of which extends between said front end surface and said rear end surface, said lateral side surfaces each being curved and projecting laterally outward with respect to the vibration head in opposite directions from one another;

one of said side surfaces defined by an elastic body, and the other of said side surfaces having a plurality of projections extending therefrom, said front end surface being curved, projecting frontward with respect to the vibration head, and having a radius of curvature smaller than that of either of said curved lateral side surfaces, and said rear end surface including a projection projecting rearward with respect to the vibration head, said projection being defined by a curved surface having a radius of curvature smaller than that of any of said curved lateral side surfaces and said curved front end surface.

* * * * *